US008659240B2

(12) United States Patent
Wang et al.

(10) Patent No.: US 8,659,240 B2
(45) Date of Patent: Feb. 25, 2014

(54) FILAMENT DETECTION CIRCUIT

(75) Inventors: Junying Wang, Guangzhou (CN); Yanshun Xue, Guangzhou (CN); Yilong Ye, Guangzhou (CN); Guoji Zhong, Guangzhou (CN)

(73) Assignee: OSRAM AG, Munich (DE)

( * ) Notice: Subject to any disclaimer, the term of this patent is extended or adjusted under 35 U.S.C. 154(b) by 73 days.

(21) Appl. No.: 13/427,930

(22) Filed: Mar. 23, 2012

(65) Prior Publication Data

US 2012/0313549 A1 Dec. 13, 2012

(30) Foreign Application Priority Data

Apr. 2, 2011 (CN) ..... 2011 1 0090131

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.

USPC ..... 315/307; 315/224; 315/291; 315/310

(58) Field of Classification Search

None

See application file for complete search history.

(56) References Cited

U.S. PATENT DOCUMENTS

| | | | | |
|---|---|---|---|---|
| 5,747,941 | A | 5/1998 | Shackle et al. | |
| 6,291,944 | B1 * | 9/2001 | Hesterman et al. | 315/224 |
| 8,247,997 | B2 * | 8/2012 | Liess et al. | 315/294 |
| 2004/0263089 | A1 * | 12/2004 | Contenti et al. | 315/225 |

FOREIGN PATENT DOCUMENTS

WO 0156337 A1 8/2001

* cited by examiner

*Primary Examiner* — Anh Tran

(57) ABSTRACT

Provided is a circuit for detecting a filament of a fluorescent lamp, wherein a first end of a first filament is connected to a second end of the first filament via an oscillation circuit, and the first end of the first filament is connected to an output of an inverter; a first end of a second filament is connected to a second end of the second filament via an oscillation circuit, wherein the first end of the second filament is connected to an internal ground; the second end of the second filament is connected to a power source, and a voltage at the second end of the second filament is used for controlling ON and OFF of an MOSFET, wherein a source of the MOSFET is connected to the internal ground.

9 Claims, 2 Drawing Sheets

FILAMENT DETECTION CIRCUIT

CROSS-REFERENCE TO RELATED APPLICATION

This application claims priority to Chinese Patent Application Serial No. 201110090131.X, which was filed Apr. 2, 2011, and is incorporated herein by reference in its entirety.

TECHNICAL FIELD

Various embodiments relate to a circuit for detecting a filament of a fluorescent lamp.

BACKGROUND

In an electronic ballast, the cold end of the fluorescent lamp is generally not connected to the internal ground. Otherwise, it is unable to detect the cold end of the fluorescent lamp.

SUMMARY

Provided is a circuit for detecting a filament of a fluorescent lamp, wherein a first end of a first filament is connected to a second end of the first filament via an oscillation circuit, and the first end of the first filament is connected to an output of an inverter; a first end of a second filament is connected to a second end of the second filament via an oscillation circuit, wherein the first end of the second filament is connected to an internal ground; the second end of the second filament is connected to a power source, and a voltage at the second end of the second filament is used for controlling ON and OFF of an MOSFET, wherein a source of the MOSFET is connected to the internal ground.

BRIEF DESCRIPTION OF THE DRAWINGS

The above and other aspects, features and advantages will be more apparent from the following description of some exemplary embodiments of the present invention in conjunction with the Drawings, in which.

DETAILED DESCRIPTION

Figure 1:
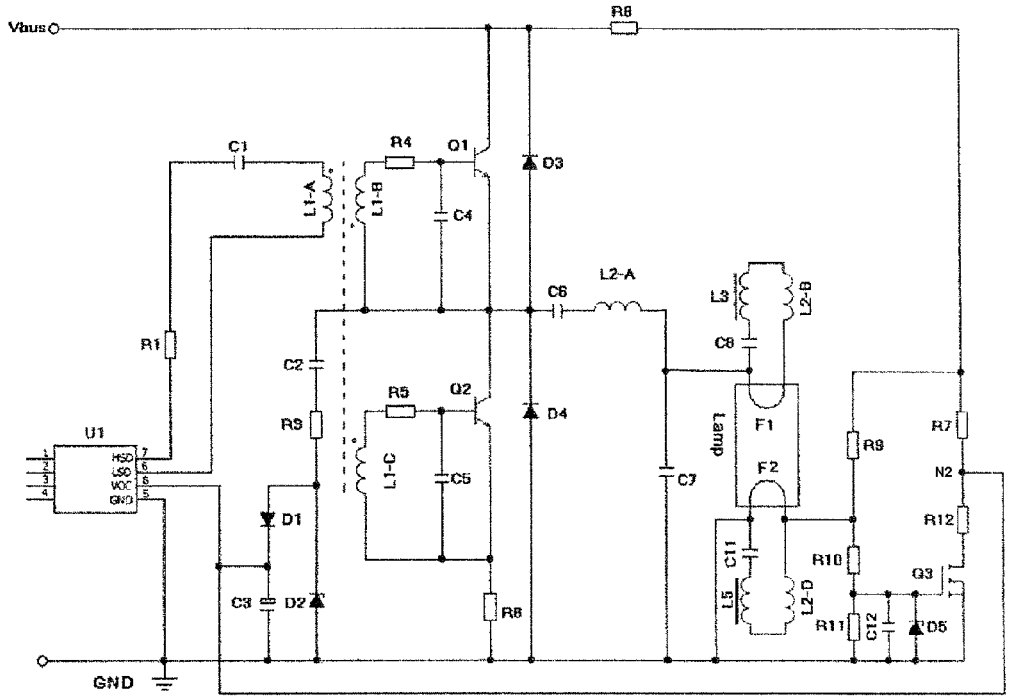
FIG. 1 is a diagram of a circuit for detecting a filament of a fluorescent lamp according to various embodiments.

By the detailed descriptions referring to the Drawings below, the present invention will be understood more easily. The same reference number throughout the specification indicates elements having the same structure. The descriptions below made by making a reference to the accompanying drawings are provided for a comprehensive understanding of the exemplary embodiments of the present invention. These descriptions include all details to facilitate understanding the present invention, and should be considered to be only exemplary. Accordingly, those skilled in the art will understand that various changes and modifications to the embodiments described herein can be made without departing from the scope and spirit of the present invention. Similarly, for clarity and conciseness, descriptions of the common function and structure are omitted.

The terms used herein are only used for describing the embodiments, but are not intended to limit the present invention. Unless being explicitly defined, all the terms (including technical and scientific terms) used herein have the same meanings as those generally understood by those skilled in the art in the present invention.

The detailed descriptions of the present invention will be given below by making a reference to the accompanying drawings.

Various embodiments may solve the aforesaid defect and problem in the prior art.

Various embodiments may solve at least this defect by grounding the cold end of the fluorescent lamp and detecting the cold end of the fluorescent lamp with a simple filament detection circuit, thereby it is able to simply realize protection of the end of lamp life.

According to various embodiments, a circuit for detecting a filament of a fluorescent lamp is provided, wherein a first end of a first filament of the fluorescent lamp is connected to a second end of the first filament via an oscillation circuit composed of a capacitor and an inductor, and the first end of the first filament is connected to an output of an inverter; a first end of a second filament of the fluorescent lamp is connected to a second end of the second filament via an oscillation circuit composed of a capacitor and an inductor, characterized in that: the first end of the second filament is connected to the internal ground; the second end of the second filament is connected to a power source via a first resistor, and a voltage at the second end of the second filament is used for controlling ON and OFF of an MOSFET, wherein a source of the MOSFET is connected to the internal ground, and a drain thereof is connected to the power source via a second resistor and a third resistor; and a node between the second resistor and the third resistor is connected to a VCC pin of an integrated circuit.

According to various embodiments, the second end of the second filament may be connected to the internal ground via a fourth resistor and a fifth resistor, and a node between the fourth resistor and the fifth resistor is connected to a gate of the MOSFET.

According to various embodiments, the circuit may further include a capacitor connected in parallel with the fifth resistor.

According to various embodiments, the circuit may further include a clamping diode connected in parallel with the fifth resistor.

According to various embodiments, a circuit for detecting a filament of a fluorescent lamp is provided, wherein the fluorescent lamp includes a first lamp and a second lamp; a first end of a first filament of the first lamp is connected to a second end of the first filament of the first lamp via an oscillation circuit composed of a capacitor and an inductor, and the first end of the first filament of the first lamp is connected to an output of an inverter; a first end of a second filament of the second lamp is connected to a second end of the second filament of the second lamp via an oscillation circuit composed of a capacitor and an inductor; the first end of the second filament of the first lamp is connected to the first end of the first filament of the second lamp, and the second end of the second filament of the first lamp is connected to the second end of the first filament of the second lamp via an oscillation circuit composed of a capacitor and an inductor, characterized in that: the first end of the second filament of the second lamp is connected to the internal ground; the second end of the second filament of the first lamp is connected to a power source; the second end of the second filament of the second lamp is connected to the second end of the first filament of the second lamp via a first resistor, and a voltage at the second end of the second filament of the second lamp is used for controlling ON and OFF of an MOSFET, wherein a source of the MOSFET is connected to the internal ground, and a drain thereof is connected to the second end of the first filament of the second lamp via a second resistor and a third resistor; and a node between the second resistor and the third resistor is connected to a VCC pin of an integrated circuit.

According to various embodiments, the second end of the second filament of the second lamp may be connected to the internal ground via a fourth resistor and a fifth resistor, and a node between the fourth resistor and the fifth resistor is connected to a gate of the MOSFET.

According to various embodiments, the circuit may further include a capacitor connected in parallel with the fifth resistor.

According to various embodiments, the circuit may further include a clamping diode connected in parallel with the fifth resistor.

According to various embodiments, the fluorescent lamp may further include one or more lamps, wherein the second filament of the first lamp, the filaments of the one or more lamps, and the first filament of the second lamp are connected to each other via an oscillation circuit composed of a capacitor and an inductor, a second end of a second filament of one of the one or more lamps that is closest to the second lamp is connected to the power source in place of the second end of the second filament of the first lamp being connected to the power source.

FIG. 1 is a diagram of a circuit for detecting a filament of a fluorescent lamp according to various embodiments.

As shown in FIG. 1, under the control of an integrated circuit (IC) U1, an inverter composed of resistors R1, R3-R6, capacitors C1-C7, diodes D1-D4, transistor switches Q1-Q2, inductors L1, L2-A and so on inverts a DC voltage Vbus to a high-frequency alternating current to be supplied to a fluorescent lamp. Since the structure of the inverter used herein is the same as that of a full-bridge or half-bridge circuit used in a conventional electronic ballast, the detailed description of the inverter is omitted herein. Besides, the person skilled in the art may employ a full-bridge or half-bridge circuit having a suitable structure according to various embodiments.

The lamp has a first filament F1 and a second filament F2. A first end of the first filament F1 is connected to a second end of the first filament F1 via a capacitor C8, an inductor L3 and an inductor L2-B (they compose an oscillation circuit), and the first end of the first filament F1 is connected to an output of the inverter. A first end of the second filament F2 is connected to a second end of the second filament F2 via a capacitor C11, inductors L5 and inductor L2-D, and the first end of the second filament F2 is connected to the internal ground GND.

In addition, the second end of the second filament F2 is connected to a power source Vbus via a resistor R9, a voltage at the second filament F2 is used for controlling ON and OFF of a gate of an MOSFET (metal oxide semiconductor field effect transistor) Q3. A source of the MOSFET Q3 is connected to the internal ground GND, and a drain thereof is connected to the power source Vbus via resistors R12 and R7. Further, a node N2 between the resistors R12 and R7 is connected to a VCC pin of the IC U1. Further, a resistor R8 may be connected between the resistor R7 and the power source Vbus.

In various embodiments, the second end of the second filament F2 may be connected to the internal ground GND via resistors R10 and R11. A node N1 between the resistors R10 and R11 is connected to a gate of the MOSFET Q3. In various embodiments, a capacitor C12 is connected in parallel with the resistor R11. In various embodiments, a clamping diode D5 is connected in parallel with the resistor R11.

By using the filament detection circuit according to one embodiment of the present invention, if the second filament F2 is inserted, since the resistance of the second filament F2 is very small, the voltage at the node between the resistors R9 and R10 is maintained low, resulting in that the gate voltage of the MOSFET Q3 is lower than the ON threshold of the MOSFET Q3. In this case, the MOSFET Q3 is maintained at OFF state, thus the pin VCC is successfully charged, thereby activating the IC U1. On the other hand, if the second filament F2 is not inserted, the capacitor C11 is charged, thus the voltage at the node between the resistors R9 and R10 is high, and the gate voltage of the MOSFET Q3 is increased to be higher than the ON threshold of the MOSFET Q3 due to the voltage division of resistors R10 and R11. In this case, the MOSFET Q3 is in the ON state, the pin VCC is discharged, so the pin VCC is not successfully charged. Thus, it is easy to realize protection of the end of lamp life.

In other words, when the pin VCC is successfully charged, it can be detected that the filament F2 is inserted; and when the pin VCC is not successfully charged, it can be detected that the filament F2 is not inserted.

A circuit for detecting filaments of two fluorescent lamps will be described below with reference to FIG. 2.

Figure 2:
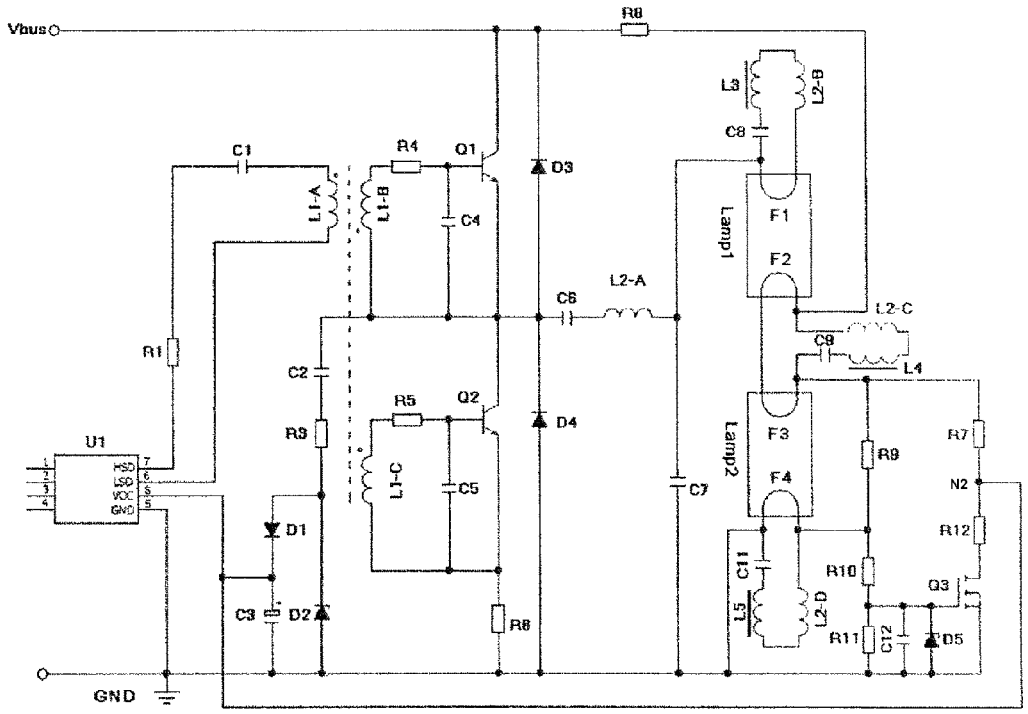
FIG. 2 is a diagram of a circuit for detecting filaments of two fluorescent lamps according to various embodiments.

FIG. 2 shows a diagram of a circuit for detecting filaments of two fluorescent lamps according to various embodiments.

Being same as in FIG. 1, under the control of the IC U1, the inverter composed of resistors R1, R3-R6, capacitors C1-C7, diodes D1-D4, transistor switches Q1-Q2, inductors L1, L2-A inverts the DC voltage Vbus to a high-frequency alternating current to be supplied to the fluorescent lamp.

However, FIG. 2 shows two lamps, i.e., a first lamp Lamp1 and a second lamp Lamp2.

The first lamp Lamp1 has a first filament F1 and a second filament F2. A first end of the first filament F1 is connected to a second end of the first filament F1 via a capacitor C8, inductors L3 and L2-B, and the first end of the first filament F1 is connected to an output of an inverter.

The second lamp Lamp2 has a first filament F3 and a second filament F4. A first end of the second filament F4 is connected to a second end of the second filament F4 via a capacitor C11, inductors L5 and L2-D.

Further, the first end of the second filament F2 of the first Lamp1 is connected to the first end of the first filament F3 of the second lamp Lamp2, the second end of the second filament F2 of the first lamp Lamp1 is connected to the second end of the first filament F3 of the second lamp Lamp2 via inductors L2-C and L4 and capacitor C9, and the second end of the second filament F2 of the first lamp is connected to the internal ground GND.

In addition, the second end of the second filament F4 of the second lamp Lamp2 is connected to the second end of the first filament F3 of the second lamp Lamp2 via a resistor R9, a voltage at the second end of the second filament F4 of the second lamp Lamp2 is used for controlling ON and OFF of a gate of an MOSFET (metal oxide semiconductor field effect transistor) Q3. A source of the MOSFET Q3 is connected to the internal ground GND, and a drain thereof is connected to the second end of the first filament F3 of the second lamp Lamp2 via resistors R12 and R7. Further, a node N2 between the resistors R12 and R7 is connected to a VCC pin of the IC U1. Further, a resistor R8 may be connected between the power source Vbus and the second end of the first filament F3 of the second lamp Lamp2.

In various embodiments, the second end of the second filament F4 of the second lamp Lamp2 may be connected to the internal ground GND via resistors R10 and R11. A node N1 between the resistors R10 and R11 is connected to a gate of the MOSFET Q3. In various embodiments, a capacitor C12 is connected in parallel with the resistor R11. In various embodiments, a clamping diode D5 is connected in parallel with the resistor R11.

By using the filament detection circuit according to one embodiment of the present invention, only when the filaments F2 and F3 are inserted, the second end of the first filament F3 of the second lamp Lamp2 is connected to the power source Vbus (for example, via resistor R8). In addition, similar to the circuit shown in FIG. 1, if the second filament F4 of the second lamp Lamp2 is inserted, since the resistance of the second filament F4 is very small, the voltage at the node between the resistors R9 and R10 is maintained low, resulting in that the gate voltage of the MOSFET Q3 is lower than the ON threshold of the MOSFET Q3. In this case, the MOSFET Q3 is maintained at OFF state, thus the pin VCC is successfully charged, thereby activating the IC U1. On the other hand, if the second filament F4 of the second lamp Lamp2 is not inserted, the capacitor C11 is charged, thus the voltage at the node between the resistors R9 and R10 is high, and the gate voltage of the MOSFET Q3 is increased to be higher than the ON threshold of the MOSFET Q3 due to the voltage division of resistors R10 and R11. In this case, the MOSFET Q3 is in the ON state, the pin VCC is discharged, so the pin VCC is not successfully charged. Thus, it is easy to realize protection of the end of lamp life.

In other words, when the pin VCC is successfully charged, it can be detected that all the filaments F2, F3, F4 are inserted; and when the pin VCC is not successfully charged, it can be detected that at least one of the filaments F2, F3, F4 is not inserted.

Certainly, the filament detection circuit according to the present invention is not limited to detecting the filament(s) of one or two lamps, it is also able to detect filaments of three or more lamps. For example, in the case when there are three lamps, a third lamp Lamp3 (not shown) may be connected between the first lamp Lamp1 and the second lamp Lamp2, wherein a first end of the second filament F2 of the first lamp Lamp1 is connected to a first end of the first filament of the third lamp Lamp3, a second end of the second filament F2 of the first lamp Lamp1 is connected to a second end of the first filament of the third lamp Lamp3 via a capacitor and an inductor, and the structure of the second filament of the third lamp Lamp3 is the same as that of the second filament F2 of the first lamp Lamp1 shown in FIG. 2.

In summary, the filament detection circuit according to various embodiments can simply realize protection of the end of lamp life, and can effectively detect the cold end of a fluorescent lamp.

Although this Description contains details of many specific embodiments, these details shall not be construed as limiting the scope of any invention or contents that can be claimed, but shall be construed as describing features of specific embodiments that can be specified in a specific invention.

The above specific embodiments do not limit the scope of protection of the present invention. Those skilled in the art can understand that various amendments, combinations, subcombinations and substitutions can be made depending on requirements for design and other factors. Any amendments, equivalent substitutions, improvements, etc. made within the spirit and principle of the present invention shall be contained in the scope of protection of the present invention.

What is claimed is:

1. A circuit for detecting a filament of a fluorescent lamp, wherein:

a first end of a first filament of the fluorescent lamp is connected to a second end of the first filament via an oscillation circuit composed of a capacitor and an inductor, and the first end of the first filament is connected to an output of an inverter;

a first end of a second filament of the fluorescent lamp is connected to a second end of the second filament via an oscillation circuit composed of a capacitor and an inductor, wherein the first end of the second filament is connected to the internal ground;

wherein the second end of the second filament is connected to a power source via a first resistor, and a voltage at the second end of the second filament is used for controlling ON and OFF of an MOSFET, wherein a source of the MOSFET is connected to the internal ground, and a drain thereof is connected to the power source via a second resistor and a third resistor; and wherein a node between the second resistor and the third resistor is connected to a VCC pin of an integrated circuit.

2. The circuit according to claim 1, wherein the second end of the second filament is connected to an internal ground via a fourth resistor and a fifth resistor, and a node between the fourth resistor and the fifth resistor is connected to a gate of the MOSFET.

3. The circuit according to claim 2, further comprising:

a capacitor connected in parallel with the fifth resistor.

4. The circuit according to claim 2, further comprising:

a clamping diode connected in parallel with the fifth resistor.

5. A circuit for detecting a filament of a fluorescent lamp, wherein:

the fluorescent lamp comprises a first lamp and a second lamp;

a first end of a first filament of the first lamp is connected to a second end of the first filament of the first lamp via an oscillation circuit composed of a capacitor and an inductor, and the first end of the first filament of the first lamp is connected to an output of an inverter;

a first end of a second filament of the second lamp is connected to a second end of the second filament of the second lamp via an oscillation circuit composed of a capacitor and an inductor;

the first end of the second filament of the first lamp is connected to the first end of the first filament of the second lamp, and the second end of the second filament of the first lamp is connected to the second end of the first filament of the second lamp via an oscillation circuit composed of a capacitor and an inductor, wherein the first end of the second filament of the second lamp is connected to the internal ground;

wherein the second end of the second filament of the first lamp is connected to a power source;

wherein the second end of the second filament of the second lamp is connected to the second end of the first filament of the second lamp via a first resistor, and a voltage at the second end of the second filament of the second lamp is used for controlling ON and OFF of an MOSFET, wherein a source of the MOSFET is connected to the internal ground, and a drain thereof is connected to the second end of the first filament of the second lamp via a second resistor and a third resistor; and wherein a node between the second resistor and the third resistor is connected to a VCC pin of an integrated circuit.

6. The circuit according to claim 5, wherein the second end of the second filament of the second lamp is connected to the internal ground via a fourth resistor and a fifth resistor, and a node between the fourth resistor and the fifth resistor is connected to a gate of the MOSFET.

7. The circuit according to claim 6, further comprising:

a capacitor connected in parallel with the fifth resistor.

8. The circuit according to claim 6, further comprising:

a clamping diode connected in parallel with the fifth resistor.

9. The circuit according to claim 5, wherein the fluorescent lamp further comprises one or more lamps, wherein:

the second filament of the first lamp, the filaments of the one or more lamps, and the first filament of the second lamp are connected to each other via an oscillation circuit composed of a capacitor and an inductor, a second end of a second filament of one of the one or more lamps that is closest to the second lamp is connected to the power source in place of the second end of the second filament of the first lamp being connected to the power source.

* * * * *